US012221964B2

(12) United States Patent
Batdorff et al.

(10) Patent No.: US 12,221,964 B2
(45) Date of Patent: Feb. 11, 2025

(54) SPIRAL VALVE FOR SCREW CAPACITY CONTROL

(71) Applicant: Hitachi Global Air Power US, LLC, Michigan City, IN (US)

(72) Inventors: Jonathan D. Batdorff, Michigan City, IN (US); Hideki Fujimoto, Shizuoka (JP); Don Weinkauf, Mishawaka, IN (US); Christian Vaughn, La Porte, IN (US)

(73) Assignee: Hitachi Global Air Power US, LLC, Michigan City, IN (US)

( * ) Notice: Subject to any disclaimer, the term of this patent is extended or adjusted under 35 U.S.C. 154(b) by 0 days.

(21) Appl. No.: 18/685,479

(22) PCT Filed: Jul. 22, 2021

(86) PCT No.: PCT/US2021/042825
§ 371 (c)(1),
(2) Date: Feb. 21, 2024

(87) PCT Pub. No.: WO2023/003559
PCT Pub. Date: Jan. 26, 2023

(65) Prior Publication Data

US 2024/0352936 A1 Oct. 24, 2024

(51) Int. Cl.
*F04C 28/24* (2006.01)
*F04C 18/16* (2006.01)

(52) U.S. Cl.
CPC ..... *F04C 28/24* (2013.01); *F04C 18/16* (2013.01); *F04C 2240/30* (2013.01); *F04C 2240/40* (2013.01)

(58) Field of Classification Search
CPC ..... F04C 18/16; F04C 28/24; F04C 28/12; F04C 29/00; F04C 29/028; F04C 29/124; F04C 2/16; F04C 2240/30; F04C 2240/40
See application file for complete search history.

(56) References Cited

U.S. PATENT DOCUMENTS 3,874,828 A 4/1975 Herschler et al.
4,025,244 A * 5/1977 Sato ..... F04C 29/0014 418/87

(Continued)

OTHER PUBLICATIONS

International Search Report and Written Opinion dated Oct. 26, 2021, in International Application No. PCT/US2021/042825.

*Primary Examiner* — Dapinder Singh
(74) *Attorney, Agent, or Firm* — Procopio, Cory, Hargreaves & Savitch LLP

(57) ABSTRACT

A spiral valve and a screw compressor having a compressor housing and the spiral valve are provided. The spiral valve includes an actuator module having an electric motor and a gearbox mechanically coupled to the electric motor to transmit a torque from the electric motor, and a spiral valve body coupled to the gearbox to rotate in response to the transmitted torque from the electric motor. The spiral valve body has a first shutter positioned to open and close one or more of a plurality of bypass ports formed in the compressor housing based on a rotational position of the second shutter, a second shutter positioned to progressively open and close a compressor inlet transfer duct formed in the compressor housing based on a rotation position of second shutter, and a gap formed between the first and second shutters.

10 Claims, 7 Drawing Sheets

(56) References Cited

U.S. PATENT DOCUMENTS

| | | | | |
|---|---|---|---|---|
| 4,042,310 | A | 8/1977 | Schibbye et al. | |
| 10,746,176 | B2 * | 8/2020 | Johnson | F25B 49/022 |
| 2015/0292762 | A1 * | 10/2015 | Clanin | G05B 15/02 700/276 |
| 2021/0079915 | A1 * | 3/2021 | Doden | F04C 18/16 |
| 2021/0095675 | A1 * | 4/2021 | Doden | F04D 15/0077 |

* cited by examiner

SPIRAL VALVE FOR SCREW CAPACITY CONTROL

BACKGROUND

Field

The present disclosure relates to a spiral valve and in particular a spiral valve configured for electronic control.

Related Art

Screw gas compressors may be known in the related art. In the related art, a screw compressor may include a compressor housing and a motor (for example, a permanent magnet rotor/stator motor) is used to drive one (e.g., a first compression screw) of the two compression screws. The second of the two compression screws may be mechanically coupled to the compression screw that is driven by the motor. The second compression screw may thus be driven by the first compression screw. In the related art, gas may be drawn into the compressor through an inlet, compressed between the two compression screws as they turn, and output through an outlet which is downstream of the gas inlet and the compression screws.

In some related art, one or more bypass ports or valve openings may be formed in the compressor housing or a rotor cowling to allow gas to exit the housing to control or prevent over pressurization or compression along the length of the compression screws. In the related art, the one or more bypass ports or valve openings may be positioned adjacent to a spiral valve that controls the opening and closing of the bypass ports or valve openings by a shutter that is rotated to a point that uncovers bypass ports and allows one or more of the bypass ports to communicate with the bypass chamber.

However, in some related art, the adiabatic efficiency of a screw air compressor equipped with a spiral valve capacity control mechanism can be reduced by the amount of gas that leaks out of the rotor housing and around the spiral valve shutter. This reduction in efficiency is due to the work wasted compressing gas that does not contribute to the capacity of the system and the hot gas and oil that leak around the spiral valve shutter enters the inlet and contributes to inlet gas preheat.

In the related art, many design tradeoffs can be made to decrease the shutter leakage. Some of these are increasing shutter overlap, increasing valve size, decreasing rotor housing window area, decreasing the clearance between the spiral valve and the rotor housing, and designing the shutter to open more abruptly. All of these either increase cost or decrease functionality.

SUMMARY

Aspects of the present disclosure may include a spiral valve for a screw compressor having a compressor housing. The spiral valve may include an actuator module disposed adjacent an exterior of the compressor housing. The actuator module may include an electric motor, a gearbox mechanically coupled to the electric motor to transmit a torque from the electric motor, and a spiral valve body coupled to the gearbox to rotate in response to the torque transmitted from the electric motor. The spiral valve body may include a first shell area defining a first shutter positioned to open and close one or more of a plurality of bypass ports formed in the compressor housing based on a rotational position of the first shutter, a second shell area defining a second shutter positioned to progressively open and close a compressor inlet transfer duct formed in the compressor housing based on a rotation position of the second shutter, and a gap formed between the first shell area and the second shell area, wherein a compression length of the screw compressor may be controlled by controlling opening and closing of the plurality of bypass ports.

Further aspects of present disclosure may include a screw compressor having a compressor housing defining a compression chamber, a female compression screw disposed within the compression chamber, a male compression screw disposed within the compression chamber and interfacing with the female compression screw, a plurality of bypass ports formed in the compressor housing and providing fluid communication through the compressor housing, a compressor inlet transfer duct formed in the compressor housing to allow fluid communication with a compressor inlet; and a spiral valve. The spiral valve may include an actuator module disposed adjacent an exterior of the compressor housing and a spiral valve body coupled to the gearbox to rotate in response to the torque transmitted from the electric motor. The actuator module may include an electric motor; and a gearbox mechanically coupled to the electric motor to transmit a torque from the electric motor. The spiral valve body may include a first shell area defining a first shutter positioned to open and close the plurality of bypass ports formed in the compressor housing based on a rotational position of the first shutter, a second shell area defining a second shutter positioned to progressively open and close the compressor inlet transfer duct formed in the compressor housing based on a rotation position of second shutter, and a gap formed between the first shell area and the second shell area, wherein a compression length of the screw compressor may be controlled by controlling opening and closing of the plurality of bypass ports.

Additional aspects of the present disclosure may include an edge of first shell area adjacent the gap being angled with respect to an axis of the spiral valve body to give the first shutter a tapered shape.

Additional aspects of the present disclosure may include an edge of second shell area adjacent the gap being orthogonal with respect to an axis of the spiral valve body to give the second shutter a rectangular shape.

Additional aspects of the present disclosure may include the spiral valve body having a hollow, partial cylindrical shell allowing fluid communication though an interior of the spiral valve body.

Additional aspects of the present disclosure may include the first shell area that defines the first shutter being configured to rotate independently from the second shell area defining a second shutter.

BRIEF DESCRIPTION OF THE DRAWINGS

A general architecture that implements the various features of the disclosure will now be described with reference to the drawings. The drawings and the associated descriptions are provided to illustrate example implementations of the disclosure and not to limit the scope of the disclosure. Throughout the drawings, reference numbers are reused to indicate correspondence between referenced elements.

DETAILED DESCRIPTION

Figure 1:
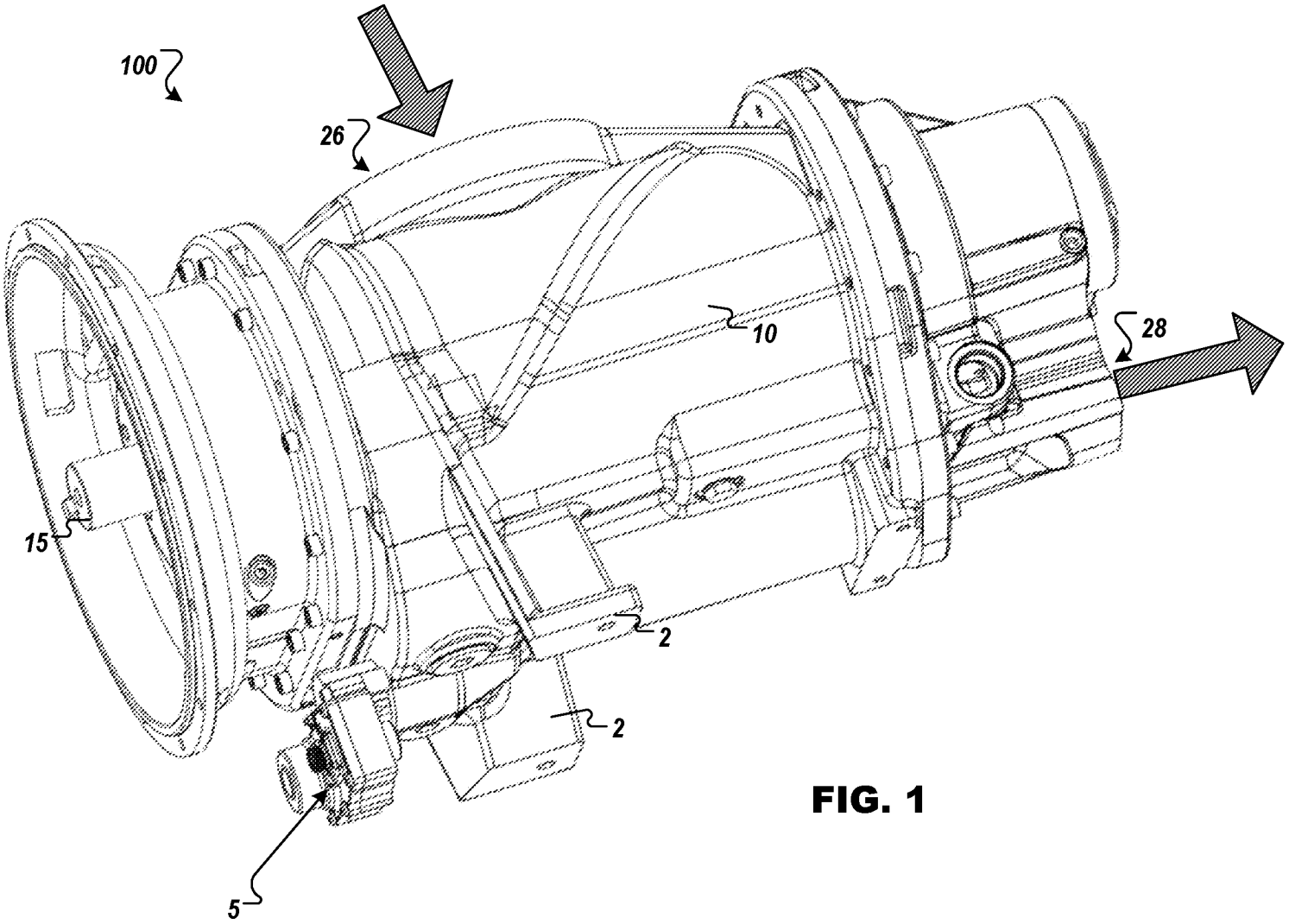
FIG. 1 illustrates a perspective view of a screw compressor having a spiral valve structure in accordance with example implementations of the present disclosure.

The following detailed description provides further details of the figures and example implementations of the present disclosure. Reference numerals and descriptions of redundant elements between figures are omitted for clarity. Terms used throughout the description are provided as examples and are not intended to be limiting. For example, the use of the term "automatic" may involve fully automatic or semi-automatic implementations involving user or operator control over certain aspects of the implementation, depending on the desired implementation of one of ordinary skill in the art practicing implementations of the present disclosure. Further, sequential terminology, such as "first", "second", "third", etc., may be used in the description and claims simply for labeling purposes and should not be limited to referring to described actions or items occurring in the described sequence. Actions or items may be ordered into a different sequence or may be performed in parallel or dynamically, without departing from the scope of the present disclosure.

As described above, related art screw compressors may include one or more bypass ports or valve openings positioned adjacent to a spiral valve that controls the opening and closing of the bypass ports or valve openings by using a shutter that is rotated to a point that uncovers bypass ports, allowing one or more of the bypass ports to communicate with the bypass chamber. However, in these related art systems, the adiabatic efficiency can be reduced by the amount of gas that leaks out of the rotor housing and around the spiral valve shutter due to work wasted compressing gas that does not contribute to the capacity of the system and the hot gas and oil that leak around the spiral valve shutter entering into the inlet and contributes to inlet gas preheat.

To address these problems, example implementations of the present disclosure may add a second shutter to the spiral valve. The second shutter traps the gas in the bypass chamber that would normally go straight to the inlet. The second shutter may be provided in an area where a shape can be used that seals more effectively. In example implementations of the present disclosure, the second shutter may be provided in an area that is not limited by the angled geometry of the rotors.

In example implementations, this trapping feature may allow the design tradeoffs of the related art to be minimized. Further, in example implementations, while the length of the spiral valve may have to be increased to incorporate the second shutter, the valve diameter, shutter overlap, the shutter opening rate would not have to be increased. This may reduce the need to decrease the clearance between the spiral valve outside diameter and rotor housing spiral valve bore. In example implementations, this configuration may also reduce a new need to reduce the window area.

FIG. 1 illustrates a perspective view of a screw compressor 100 having a spiral valve structure in accordance with example implementations of the present disclosure. As illustrated, the screw compressor 100 includes a compressor housing 10 that surrounds the compressor inner structure and forms a compression chamber 3 (not shown in FIG. 1, illustrated in FIG. 2B). The housing 10 may include one or more mounting brackets or feet 2 that support the screw compressor 100 and allow the screw compressor 100 to be secured to a floor or other support platform. For example, the feet 2 may allow the screw compressor 100 to be mounted on a portable support platform or trailer. The housing 10 also defines a main gas flow intake or compressor inlet 26, and a main gas flow discharge 28. Arrows are provided to illustrate gas flow through the screw compressor 100. Additionally, the compressor housing 10 may allow a drive shaft 15 to pass from the compressor inner structure (illustrated in FIG. 2B) to the area surrounding the compressor 100.

The drive shaft 15 may be used to mechanically couple the screw compressor 100 to a motor or engine to drive the screw compressor 100. The screw compressor 100 may be driven by an IC Engine, such as a gasoline engine, a diesel engine, or any other type of engine that might be apparent to a person of ordinary skill in the art. The screw compressor 100 may also be driven by an electric motor, or any type of machine that supplies rotary motive power that might be apparent to a person of ordinary skill in the art.

Further, an actuator module 5 may be disposed and attached to the exterior of compressor housing 10 and control a spiral valve 300 (shown in FIGS. 2B and 3-7) located within the compressor housing 10. As described below, the actuator module 5 may include an electric motor coupled to a gearbox that is coupled to the spiral valve to rotate in response to torque generated by the electric motor and transmitted by the gearbox. Additionally, the actuator module 5 may also include an integrated processor component that may include onboard control logic that controls the actuator module 5 automatically, semi-automatically based partially on a user input or manually based entirely on a user input.

Figure 2B:
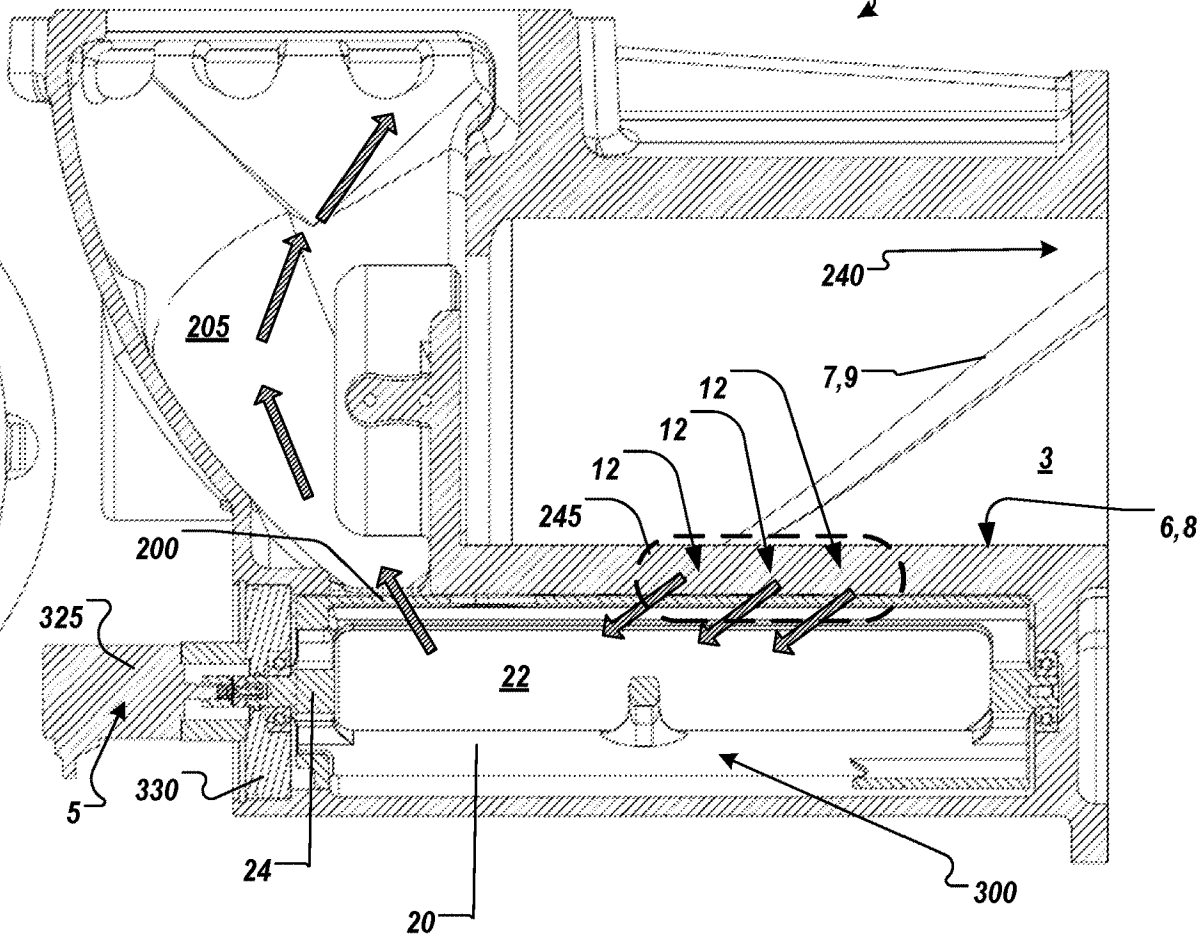
FIG. 2B illustrates a sectional view of FIG. 2A taken along line IIb-IIb'.
Figure 2A:
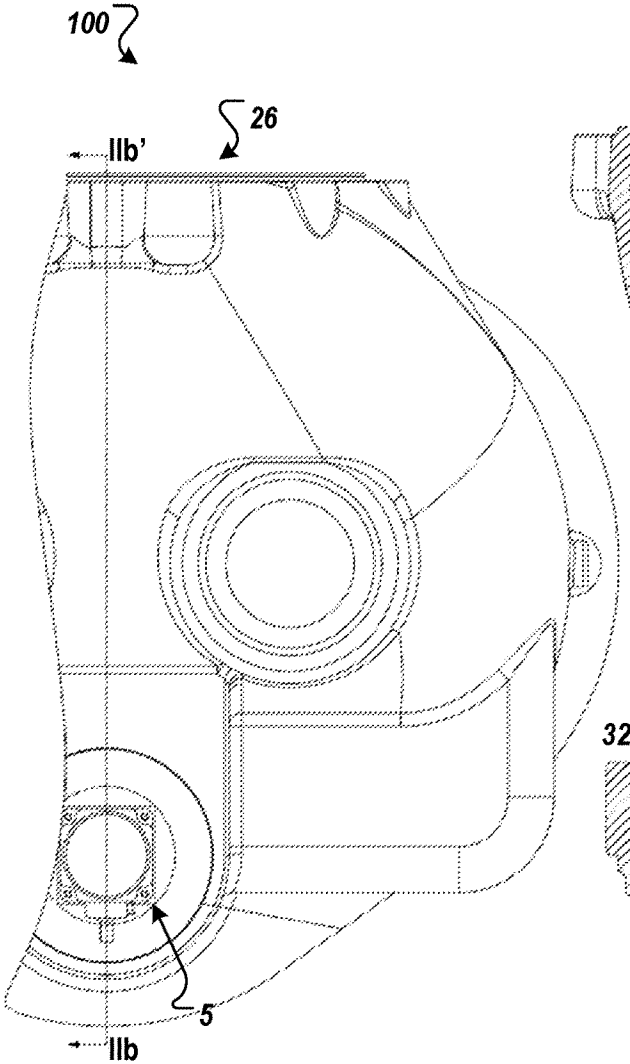
FIG. 2A illustrates a partial end view of the screw compressor having the spiral valve structure of FIG. 1.

FIG. 2A illustrates a partial end view of the screw compressor 100 having the spiral valve structure of FIG. 1. FIG. 2B illustrates a sectional view of FIG. 2A taken along line IIb-IIb'. The compressor housing 10 forms a compression chamber 3 defining two adjoining bores 6 and 8, within each of which is disposed a screw 7 and 9 of the twin screw gas compressor 100, when the unit is assembled and functioning. One of the screws 9 (also known as the drive screw) is mechanically coupled to shaft 15. The motor or engine that drives the screw gas compressor is coupled to shaft 15. The other screw 7 (also known as the driven screw) is driven by drive screw 9. Both screws 7, 9 may each be supported by a bearing group (not shown herein), such as roller bearings or any other type of bearing or bushing that might be apparent to a person of ordinary skill in the art.

Further, in some example implementations, one of the screws may have a female lobe configuration, and the other of the screws may have a male lobe configuration. In other words, one of the screws may be a female compressor screw and the other screw may be a male compressor screw that interfaces with the female compressor screw. For example, the drive screw 9 may be a male compression screw and the driven screw 7 may be a female compression screw. As may be apparent to a person of ordinary skill in the art, example implementations of the present disclosure are not limited to this configuration and some example implementations may have an alternative configuration (e.g., the drive screw 9 may be a female compression screw and the driven screw 7 may be a male compression screw).

Each bore 6 and 8 also comprises one or more bypass ports 12 that fluidly communicates with a bypass chamber 22 that contains a spiral valve body 20 that is rotatable along an axis 24. The length of each bore 6, 8 associated with the bypass ports 12 may be referred to as the bypass window 245. The bypass chamber 22 may communicate with a compressor inlet return chamber 205 via a compressor inlet transfer duct 200. Air entering the bypass chamber 22 may be selectively returned to the compressor inlet 26 through the compressor inlet return chamber 205.

As illustrated in FIGS. 3-7 below, the spiral valve body 20 includes a first shutter 335 that selectively either blocks (closes) or opens the bypass ports 12, depending on a rotational position of the spiral valve body 20. As the spiral valve body 20 is turned to a point that allows one or more of the bypass ports 12 to fluidly communicate with the bypass chamber 22, the effective compression volume of the compression chamber 3 may be reduced due to the smaller compression chamber length. Additionally, the spiral valve body 20 includes a second shutter 340 that progressively blocks (closes) or opens the compressor inlet transfer duct 200 to allow air out of the bypass chamber 22.

The spiral valve body 20 is coupled to an actuator module 5 that controls the rotation and position of the first shutter 335 of the spiral valve body 20. As illustrated, the actuator module 5 includes a motor 325 mechanically coupled to a gearbox 330. The gearbox 330 mechanically couples the motor 325 to the spiral valve body 20. Thus, a torque from the motor may be transmitted to the first shutter 335 of the spiral valve body 20 by the gearbox 330 causing the first shutter 335 to rotate. The motor 325 may be an electric actuator motor or stepper motor that provides precise control of rotational speed and rotational position of the spiral valve.

The actuator module 5 may be attached to the compressor housing 10 to control a spiral valve structure located within the compressor housing 10. Additionally, the actuator module 5 may also include an integrated processor component that may include onboard control logic that controls the motor 325 module automatically, semi-automatically based partially on a user input or manually based entirely on a user input.

The spiral valve body 20 may be rotated (or actuated) along its axis 24 from a fully open position (where all of the bypass ports 12 are open) to a fully closed position (where all of the bypass ports are closed), and all points in between.

In some example implementations, the spacing or distance between adjacent bypass ports 12 (e.g., the spacing between a first bypass port and a second bypass port adjacent to the first bypass port) may be within 20% of the minimum spacing permitted based on the manufacturing tolerances associated with the compressor housing 10 manufacturing (e.g., less than 120% of the manufacturing tolerance and greater than or equal to 100% of the manufacturing tolerance). For example, if the compressor housing 10 is formed by a casting process, the casting tolerances may require that the minimum bypass port spacing be at least 5 mm in order to permit proper molten metal flow in the casting mold. If the casting tolerances are 5 mm, then the spacing between adjacent bypass ports may be less than 6 mm (the 5 mm casting tolerance+20%) and greater than or equal to 5 mm (the casting tolerance). Different bypass port spacing parameters may be dictated by different manufacturing tolerances.

In some example implementations, the leading edge of the first bypass port 12 of the bypass window 245 associated with the compression screw 7, 9 of the screw compressor 100 may be positioned at or in front (on inlet side) of an apex (greatest diameter) of the first lobe of the compression screw 7, 9. Further, in some example implementations, the trailing edge of the last bypass port 12 of the bypass window 245 may be located at a position of the apex (greatest diameter) of the lobe of the compression screw 7, 9 that is located in a position where a lowest desired compression volume would be produced. In other words, the volume between the lobe and the chamber outlet end 240 may be associated with lowest desired compression volume of the bore 6 of the screw compressor 100. Thus, the last bypass port 12 may be positioned adjacent to the apex of the lobe in some example implementations.

FIGS. 3-7 illustrate sectional views of the spiral valve 300 with the spiral valve body 20 rotated into sequential rotational positions. As illustrated, the bypass chamber 22 has a generally cylindrical shell and extends from adjacent to the compression chamber 3 to adjacent to the compressor-inlet return chamber 205. The spiral valve body 20 may be inserted into the generally cylindrical bypass chamber 22 and may have a hollow, partially cylindrical shell that closely contacts an inner surface 345 of the cylindrical bypass chamber 22 and allows fluid communication through the interior of the spiral valve body.

In some example implementations, partial cylindrical shell of the spiral valve body 20 may form at least two shell areas 350*a*, 350*b* or tabs, with each shell area functioning as one of the first shutter 335 and the second shutter 340 of the spiral valve body 5. A gap 355 may be formed between the shell area 350*b* (second shutter 340) and the shell area 350*a* (first shutter 335) to separate the first and second shutters 335, 340. In some example implementations, the edge 360 of the shell area 350*b* (second shutter 340) adjacent to the gap 355 may be substantially orthogonal to the axis 24 of the spiral valve body 20 such that the second shutter 340 has a substantially rectangular shape. Further, the edge 365 of the shell area 350*a* (first shutter 335) adjacent to the gap 355 may be angled with respect to the axis 24 of the spiral valve body 20 to give the first shutter a tapered shape.

As the spiral valve body 20 is mechanically coupled to the actuator module 5 by the gearbox 330 and the motor 325 of the actuator module 5 can selectively rotate the spiral valve body 20 to gradually open the first shutter 335 to sequentially expose the bypass ports 12 to progressively increase the size of the bypass window 245 and incrementally open the second shutter to gradually open the compressor inlet transfer duct 200. In some example implementations, the first shutter 335 and the second shutter 340 may rotate together such that relative rotation between the first shutter 335 and the second shutter 340 is prevented.

In other example implementations, the actuator module 5 may rotate the first shutter 335 and the second shutter 340 independently from each other. For example, spiral valve body 20 may be configured with the first shell area 350*a* being rotatable relative to the second shell area 350*b* and the gearbox 330 may be configured to rotate the first shell area 350*a* and the second shell area 350*b* in different increments based on an input rotation from the motor 325. Alternatively, the actuator module may use two motors 325 to rotate the first shell area 350*a* and the second shell area 350*b* independently.

Figure 3:
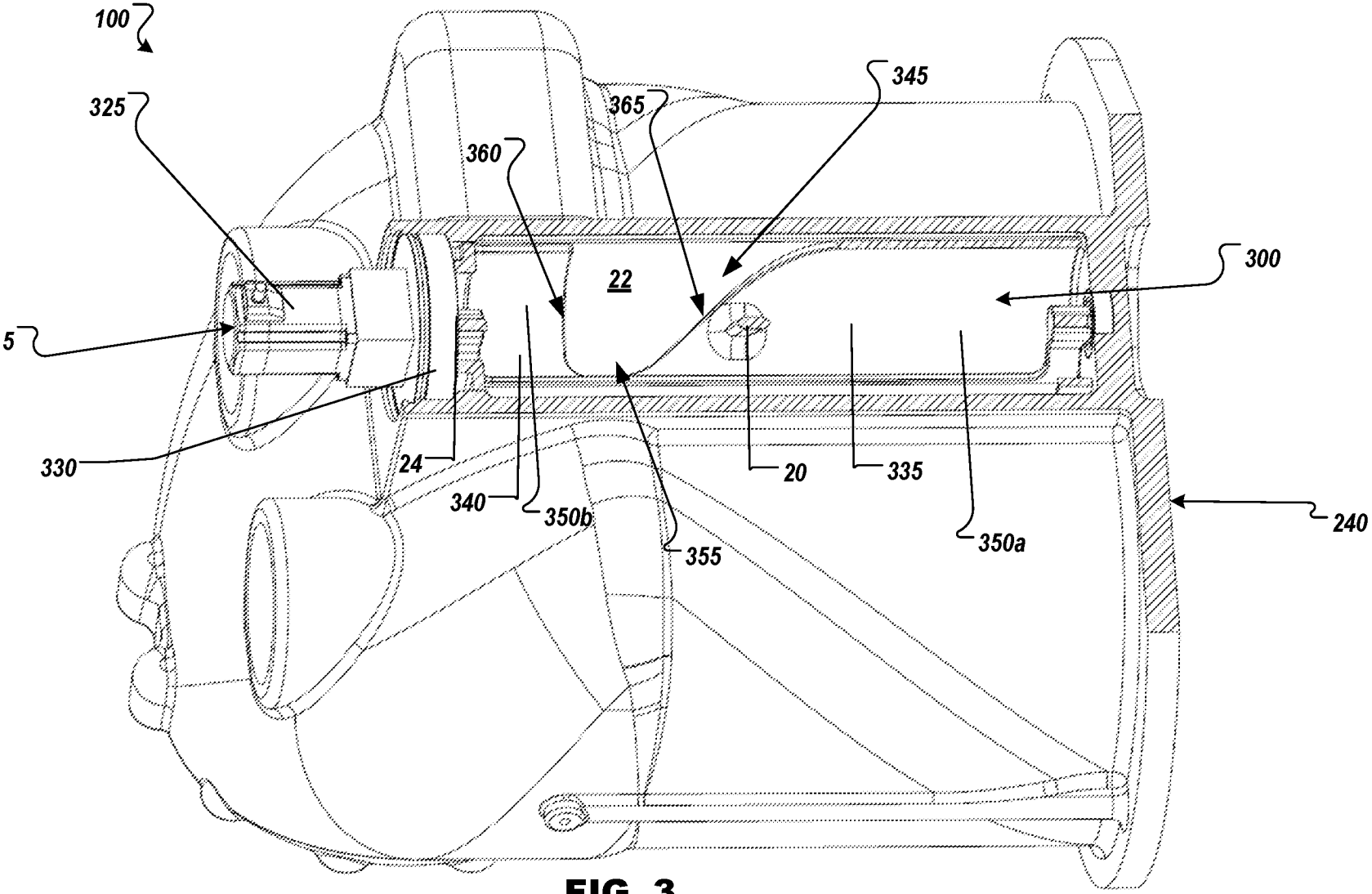
FIGS. 3-7 illustrate sectional views of the spiral valve structure with the shutter valve rotated into sequential rotational positions.

In FIG. 3, the spiral valve body 20 is illustrated in fully closed position in which the first shutter 335 closes all of the bypass ports 12 and the second shutter 340 entirely covers the compressor inlet transfer duct 200. In this configuration, the bypass chamber 22 does not communicate with the compression chamber 3, nor does the bypass chamber 22 communicate with the compressor inlet return chamber 205. With all of the bypass ports closed, the effective compression length of the compression chamber 3 is defined by the entire length of the compression chamber 3.

Figure 4:
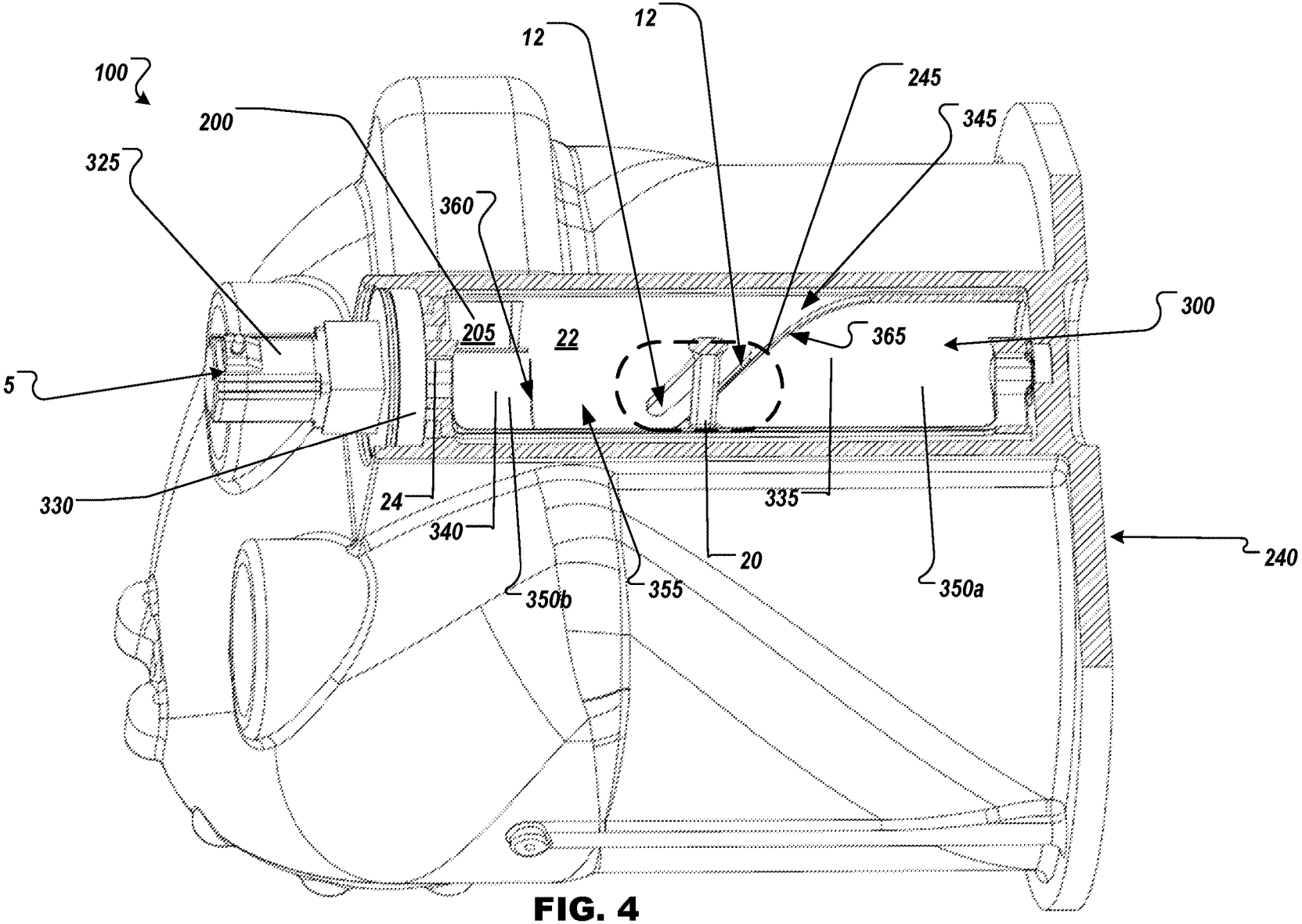

In FIG. 4, the spiral valve body 20 is illustrated in a first stage of partially opened position in which the first shutter 335 only exposes one or two bypass ports 12 to create a small bypass window 245. Further, the second shutter 340 partially exposes the compressor inlet transfer duct 200. In this configuration, the bypass chamber 22 can only communicate with the compression chamber 3 through the first one or two bypass ports 12. Further, the bypass chamber 22 can communicate with the compressor inlet return chamber 205 through an outer most portion of the compressor inlet transfer duct 200.

With at least one bypass port open, the effective compression length of the compression chamber 3 is defined by the distance between the open bypass port closest to compression chamber outlet end 240 and the compression chamber outlet end 240 itself. Thus, in the configuration of FIG. 4, the effective compression length of the compression chamber 3 has been decreased from the configuration of FIG. 3.

Figure 5:
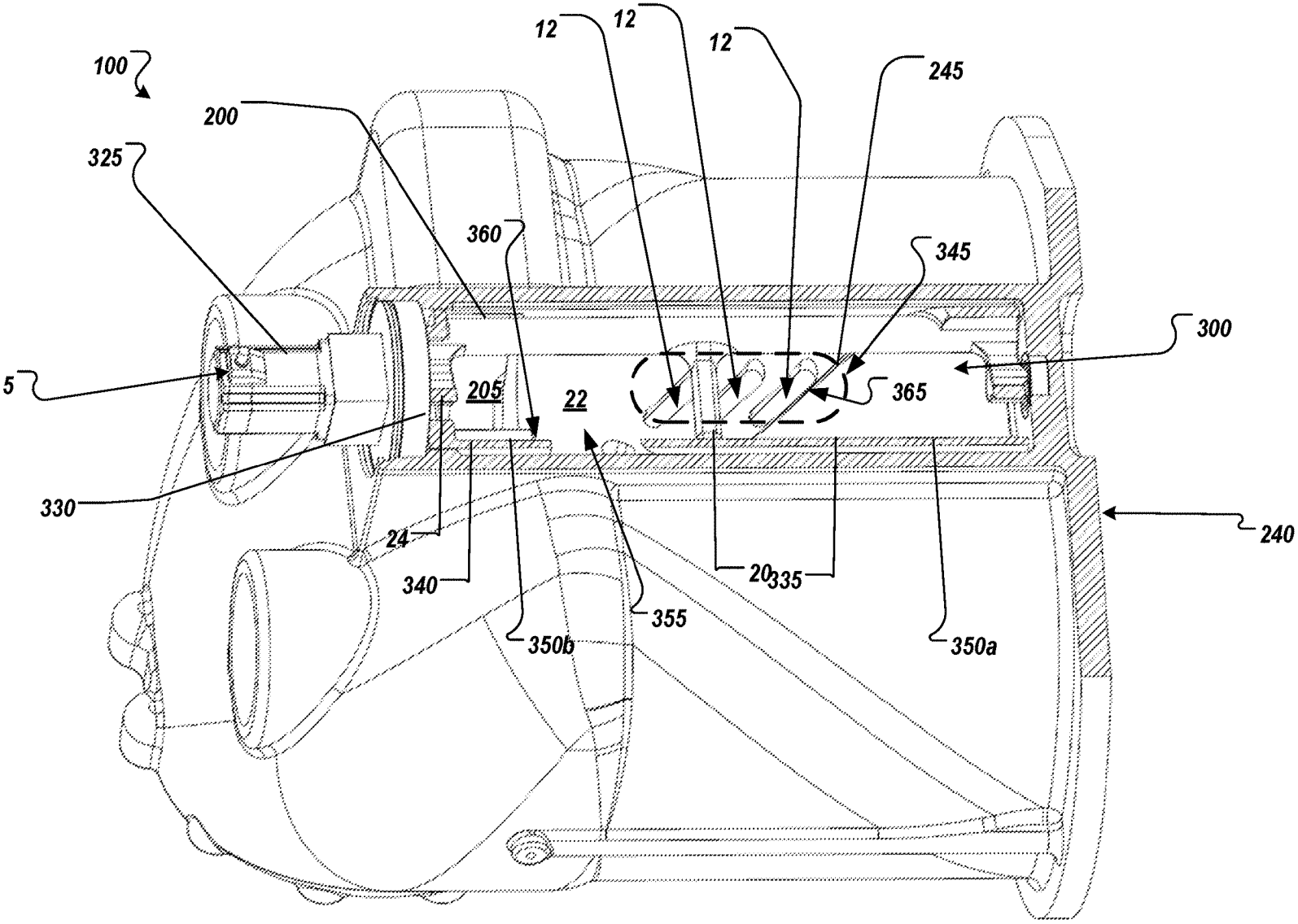

In FIG. 5, the spiral valve body 20 is illustrated in a second stage of partially opened position in which the first shutter 335 exposes three or more bypass ports 12 to create a larger bypass window 245. Further, the second shutter 340 further exposes more of the compressor inlet transfer duct 200. In this configuration, the bypass chamber 22 can communicate with the compression chamber 3 through at least the first three bypass ports 12. Further, the bypass chamber 22 can communicate with the compressor inlet return chamber 205 through nearly half of the compressor inlet transfer duct 200.

With multiple bypass ports open, the effective compression length of the compression chamber 3 is defined by the distance between the last open bypass port closest to compression chamber outlet end 240 and the compression chamber outlet end 240 itself. Thus, in the configuration of FIG. 5, the effective compression length of the compression chamber 3 has been decreased from the configuration of FIG. 4.

Figure 6:
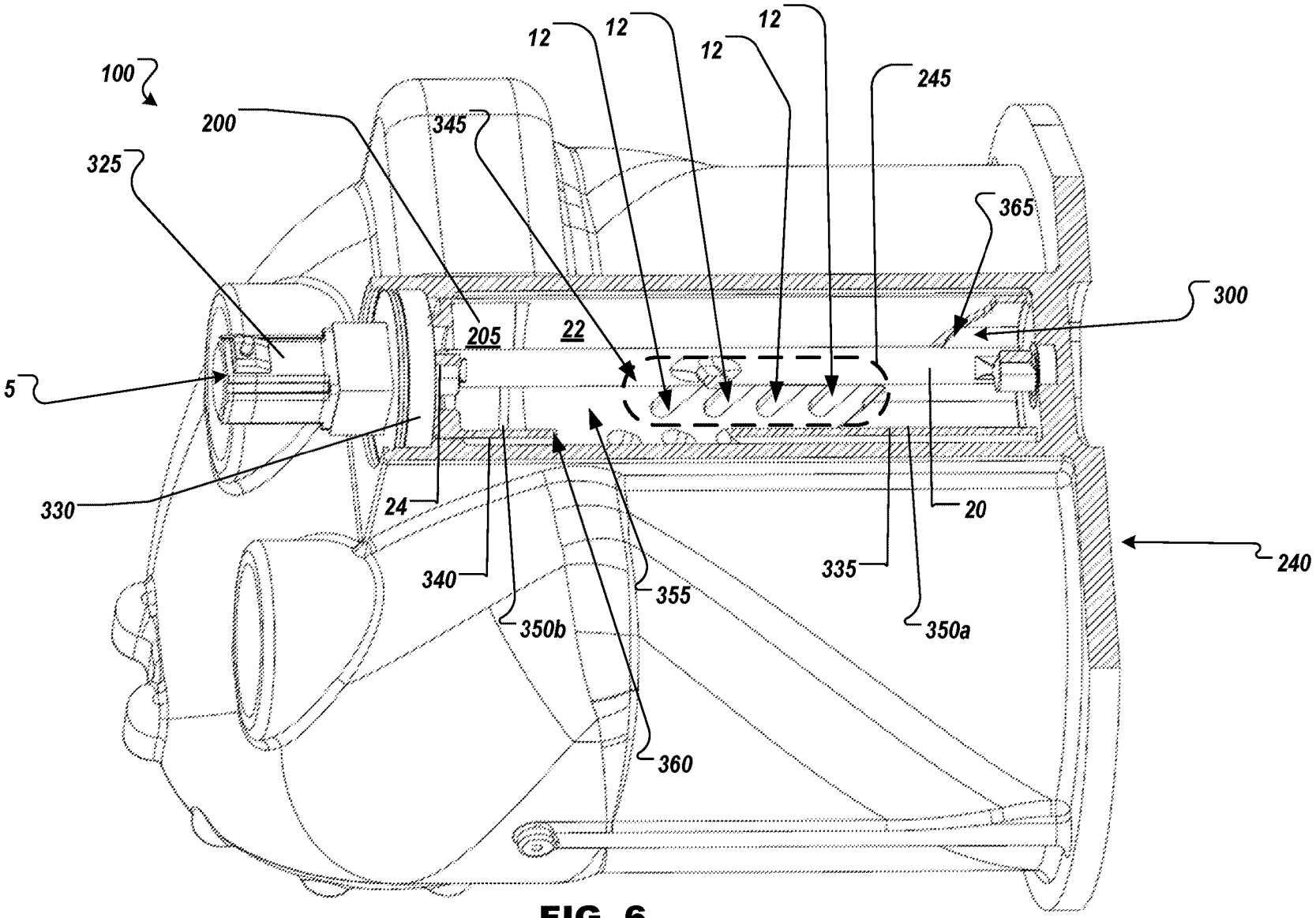

In FIG. 6, the spiral valve body 20 is illustrated in a third stage or a nearly fully opened position, in which the first shutter 335 exposes at least four bypass ports 12 to create a still larger bypass window 245. Further, the second shutter 340 further exposes most of the compressor inlet transfer duct 200 but still partially blocks the compressor inlet transfer duct 200. In this configuration, the bypass chamber 22 can communicate with the compression chamber 3 through nearly all of bypass ports 12. Further, the bypass chamber 22 can communicate with the compressor inlet return chamber 205 through most of the compressor inlet transfer duct 200, with only a small portion of the compressor inlet transfer duct 200 being blocked.

With nearly all of the bypass ports open, the effective compression length of the compression chamber 3 is defined by the distance between the last open bypass port closest to compression chamber outlet end 240 and the compression chamber outlet end 240 itself. Thus, in the configuration of FIG. 6, the effective compression length of the compression chamber 3 has been decreased from the configuration of FIG. 5.

Figure 7:
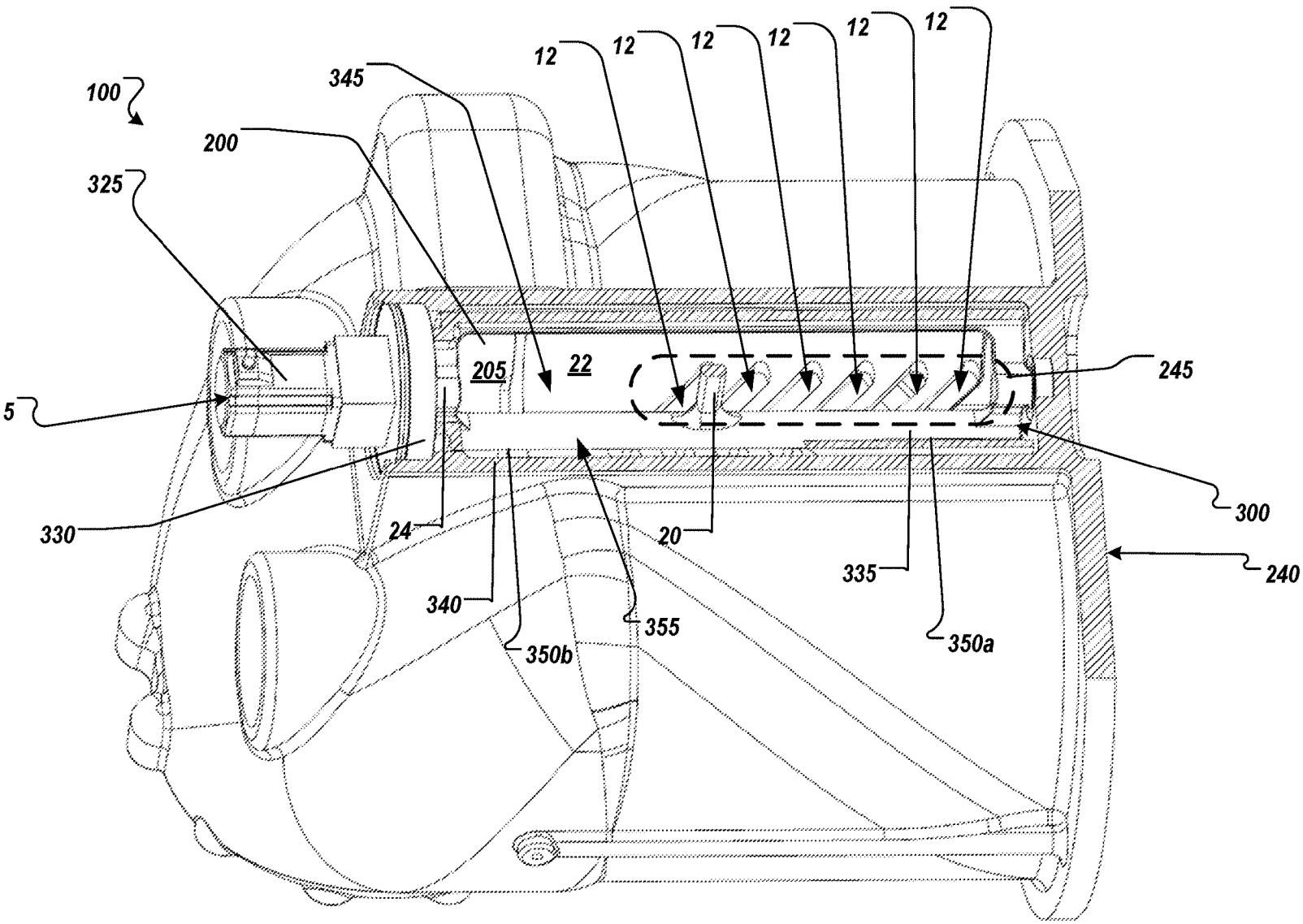

In FIG. 7, the spiral valve body 20 is illustrated in a fourth stage or a fully opened position, in which the first shutter 335 exposes all of bypass ports 12 to create the largest possible bypass window 245. Further, the second shutter 340 exposes the entire compressor inlet transfer duct 200. In this configuration, the bypass chamber 22 can communicate with the compression chamber 3 through all of bypass ports 12. Further, the bypass chamber 22 can communicate with the compressor inlet return chamber 205 through the entire compressor inlet transfer duct 200.

With all of the bypass ports open, the effective compression length of the compression chamber 3 is defined by the distance between the last open bypass port in the compression chamber 3 and the compression chamber outlet end 240 itself. Thus, in the configuration of FIG. 7, the effective compression length of the compression chamber 3 has been decreased to the smallest compression length of the compression chamber 3.

When the effective compression volume is reduced in this manner, torque is reduced, which saves power, increases efficiency, and extends the life of the components of the screw compressor 100.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed. Moreover, example implementations are not limited to industrial or fixed location; portable configurations may be achieved by mounting the screw compressor 100 on a vehicle, trailer or other portable structure.

The foregoing detailed description has set forth various example implementations of the devices and/or processes via the use of diagrams, schematics, and examples. Insofar as such diagrams, schematics, and examples contain one or more functions and/or operations, each function and/or operation within such diagrams or examples can be implemented, individually and/or collectively, by a wide range of structures. While certain example implementations have been described, these implementations have been presented by way of example only and are not intended to limit the scope of the protection. Indeed, the novel methods and apparatuses described herein may be embodied in a variety of other forms. Furthermore, various omissions, substitutions and changes in the form of the devices and systems described herein may be made without departing from the spirit of the protection. The accompanying claims and their equivalents are intended to cover such forms or modifications as would fall within the scope and spirit of the protection.

What is claimed:

1. A spiral valve for a screw compressor having a compressor housing, the spiral valve comprising:

an actuator module disposed adjacent an exterior of the compressor housing, the actuator module comprising:

an electric motor;

a gearbox mechanically coupled to the electric motor to transmit a torque from the electric motor; and a spiral valve body coupled to the gearbox to rotate in response to the torque transmitted from the electric motor, wherein spiral valve body comprises:

a first shell area defining a first shutter positioned to open and close one or more of a plurality of bypass ports formed in the compressor housing based on a rotational position of the first shutter;

a second shell area defining a second shutter positioned to progressively open and close a compressor inlet transfer duct formed in the compressor housing based on a rotation position of the second shutter; and a gap formed between the first shell area and the second shell area, wherein a compression length of the screw compressor is configured to be controlled by controlling opening and closing of the plurality of bypass ports, and wherein the first shell area is rotatable relative to the second shell area.

2. The spiral valve of claim 1, wherein an edge of first shell area adjacent the gap is angled with respect to an axis of the spiral valve body to give the first shutter a tapered shape.

3. The spiral valve of claim 1, wherein an edge of second shell area adjacent the gap is orthogonal with respect to an axis of the spiral valve body to give the second shutter a rectangular shape.

4. The spiral valve of claim 1, wherein spiral valve body has a hollow, partial cylindrical shell allowing fluid communication though an interior of the spiral valve body.

5. The spiral valve of claim 1, wherein the first shell area defining the first shutter is configured to rotate independently from the second shell area defining a second shutter.

6. A screw compressor comprising:

a compressor housing defining a compression chamber;

a female compression screw disposed within the compression chamber;

a male compression screw disposed within the compression chamber and interfacing with the female compression screw;

a plurality of bypass ports formed in the compressor housing and providing fluid communication through the compressor housing;

a compressor inlet transfer duct formed in the compressor housing to allow fluid communication with a compressor inlet; and a spiral valve comprising:

an actuator module disposed adjacent an exterior of the compressor housing, the actuator module comprising:

an electric motor;

a gearbox mechanically coupled to the electric motor to transmit a torque from the electric motor;

a spiral valve body coupled to the gearbox to rotate in response to the torque transmitted from the electric motor, wherein spiral valve body comprises:

a first shell area defining a first shutter positioned to open and close the plurality of bypass ports formed in the compressor housing based on a rotational position of the first shutter;

a second shell area defining a second shutter positioned to progressively open and close the compressor inlet transfer duct formed in the compressor housing based on a rotation position of second shutter; and a gap formed between the first shell area and the second shell area, wherein a compression length of the screw compressor is configured to be controlled by controlling opening and closing of the plurality of bypass ports, and wherein the first shell area is rotatable relative to the second shell area.

7. The screw compressor of claim 6, wherein an edge of first shell area adjacent the gap is angled with respect to an axis of the spiral valve body to give the first shutter a tapered shape.

8. The screw compressor of claim 6, wherein an edge of second shell area adjacent the gap is orthogonal with respect to an axis of the spiral valve body to give the second shutter a rectangular shape.

9. The screw compressor of claim 6, wherein spiral valve body has a hollow, partial cylindrical shell allowing fluid communication though an interior of the spiral valve body.

10. The screw compressor of claim 6, wherein the first shell area defining the first shutter is configured to rotate independently from the second shell area defining a second shutter.

* * * * *